US011617040B2

(12) United States Patent
Tao et al.

(10) Patent No.: US 11,617,040 B2
(45) Date of Patent: Mar. 28, 2023

(54) VIBRATION SYSTEM, SOUNDING DEVICE AND ELECTRONIC DEVICE

(71) Applicant: AAC Microtech (Changzhou) Co., Ltd., Changzhou (CN)

(72) Inventors: Weiwei Tao, Shenzhen (CN); Xin Jin, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/535,506

(22) Filed: Nov. 24, 2021

(65) Prior Publication Data

US 2022/0210569 A1 Jun. 30, 2022

(30) Foreign Application Priority Data

Dec. 25, 2020 (CN) ..... 202023201334.5

(51) Int. Cl.
*H04R 9/04* (2006.01)
*H04R 9/06* (2006.01)
*H04R 9/02* (2006.01)

(52) U.S. Cl.
CPC ..... *H04R 9/046* (2013.01); *H04R 9/025* (2013.01); *H04R 9/06* (2013.01); *H04R 2499/11* (2013.01)

(58) Field of Classification Search
CPC ..... H04R 9/046; H04R 9/025; H04R 9/06; H04R 2499/11; H04R 7/18; H04R 9/045; H04R 9/02; H04R 2307/207
USPC ..... 381/409, 424, 395, 412, 398, 410
See application file for complete search history.

(56) References Cited

U.S. PATENT DOCUMENTS

| | | | | |
|---|---|---|---|---|
| 2011/0123061 | A1* | 5/2011 | Kamimura | H04R 31/00 381/412 |
| 2018/0124520 | A1* | 5/2018 | Schoeffmann | H04R 9/06 |
| 2019/0075400 | A1* | 3/2019 | Hintennach | H04R 7/18 |
| 2020/0213752 | A1* | 7/2020 | Xiao | H04R 7/12 |
| 2020/0413171 | A1* | 12/2020 | Shen | H04R 9/025 |
| 2020/0413184 | A1* | 12/2020 | Zhang | H05K 1/189 |

* cited by examiner

*Primary Examiner* — Alexander Krzystan
*Assistant Examiner* — Julie X Dang
(74) *Attorney, Agent, or Firm* — W&G Law Group

(57) ABSTRACT

Provided is a vibration system, a sounding device and an electronic device. The vibration system includes a voice membrane, a voice coil configured to drive the voice membrane to vibrate, and a holder having a pad. The voice membrane includes a dome and a first diaphragm arranged around the dome. The dome and the first diaphragm are fixed to the holder. The voice coil is connected to the pad through a lead wire. The dome includes a first end close to the pad and a second end away from the pad and opposite to the first end. The second end has a positioning portion. The holder has a sink configured to receive the positioning portion. The dome is positioned with the holder through engagement of the sink with the positioning portion. Good symmetry of assembly is provided between the holder and the dome in the related art.

10 Claims, 6 Drawing Sheets

VIBRATION SYSTEM, SOUNDING DEVICE AND ELECTRONIC DEVICE

TECHNICAL FIELD

The present disclosure relates to the field of acoustic design technologies, and in particular, to a vibration system, a sounding device and an electronic device.

BACKGROUND

As a main device to transmit sound information, a sounding device can be used to play music and video and so on, and thus is widely used in various electronic devices. With the advent of the Internet era, the number of mobile terminal devices continues to rise. Mobile phones are undoubtedly the most common and portable mobile terminal devices, greatly facilitating users' daily life. As the main device to transmit sound information, the sounding device forms an important part of mobile devices.

In the related art, the sounding device includes structures such as a vibration system, a magnetic circuit unit and a frame. The vibration system includes structures such as a holder and a dome. When the dome is assembled with the holder, symmetry of the assembly between the dome and the holder is required to be ensured. Symmetry of an existing dome structure is required to be adjusted repeatedly, leading to low assembly efficiency and unsatisfactory symmetry.

Therefore, there is a need to provide a vibration system, a sounding device and an electronic device to solve the above problems.

SUMMARY

An objective of the present disclosure is to provide a vibration system, a sounding device and an electronic device, so as to solve the technical problem of poor symmetry of assembling between the holder and the dome in the related art.

The technical solution of the present disclosure is as follows. In order to achieve the above objective, the present disclosure provides a vibration system, the vibration system including a voice membrane, a voice coil configured to drive the voice membrane to vibrate, and a holder provided with a pad. The voice membrane includes a dome and a first diaphragm arranged around the dome. The dome and the first diaphragm are fixed to the holder. The voice coil is connected to the pad through a lead wire. The dome includes a first end close to the pad and a second end away from the pad and arranged opposite to the first end, and the second end is provided with a positioning portion. The holder is provided with a sink configured to receive the positioning portion, and the dome is positioned with the holder through engagement of the sink with the positioning portion.

As an improvement, the positioning portion extends from an edge of the dome to the sink.

As an improvement, the dome is provided with a first notch, and the positioning portion is received in the first notch.

As an improvement, the vibration system further includes a flexible printed circuit board opposite to and spaced from the first diaphragm, and a second diaphragm arranged on one side of the flexible printed circuit board away from the first diaphragm. The holder includes a main body portion connected to the dome and the first diaphragm, a first extension arm bending and extending from an inner periphery of the main body portion, and a second extension arm bending and extending from an outer periphery of the main body portion. The first extension arm is fixedly connected to the voice coil to suspend the voice coil below the dome, the second extension arm is fixedly connected to the flexible printed circuit board. A pad of the flexible printed circuit board bends and extends from an inner side of the second extension arm to one side of the main body portion close to the second diaphragm.

As an improvement, the main body portion is provided with a concave portion for receiving the pad.

As an improvement, the concave portion protrudes on one side of the main body portion away from the second diaphragm, and the dome is provided with a second notch at a position corresponding to the concave portion.

The present disclosure further provides a sounding device, including the vibration system described above, a magnetic circuit unit configured to drive the vibration system to vibrate and sound, and a frame configured to mount the vibration system and the magnetic circuit unit.

As an improvement, the magnetic circuit unit includes a yoke, a main magnet fixed to the yoke, an auxiliary magnet arranged on a peripheral side of the main magnet, a main pole plate attached to one side of the main magnet away from the yoke, and an auxiliary pole plate attached to one side of the auxiliary magnet away from the yoke, a magnetic gap is formed between the auxiliary magnet and the main magnet, and the voice coil is inserted into the magnetic gap, the auxiliary pole plate is arranged around the voice coil, and the auxiliary pole plate is provided with a first recess at a position corresponding to an orthographic position of the pad to avoid the pad.

As an improvement, the auxiliary pole plate is of an axisymmetric structure, and the other side of the auxiliary pole plate opposite to the first recess is provided with a second recess symmetric with the first recess.

The present disclosure further provides an electronic device, including the sounding device as described above.

The present disclosure has the following beneficial effects. In the vibration system according to the present disclosure, the holder is provided with a sink, the dome is provided with a positioning portion at a position corresponding to the sink, and the positioning portion is extended into the sink so as to position the dome and the holder. In addition, the positioning portion can also balance mass of the pad extending from the flexible printed circuit board, so that the overall mass is symmetric and the sound output is of better quality. The symmetry of assembly between the holder and the dome can be effectively improved through implementation of the above embodiments.

REFERENCE SIGNS

Figure 1:
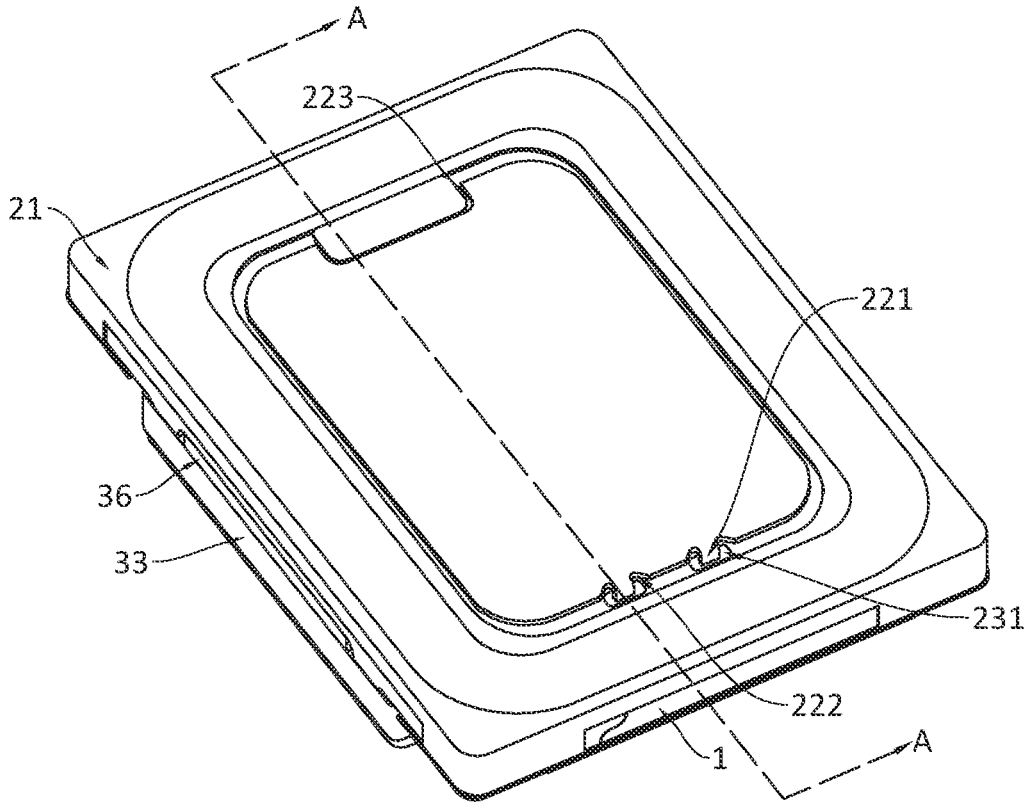
FIG. 1 is a schematic diagram of a completed assembly of an overall structure of a sounding device according to the present disclosure.
Figure 2:
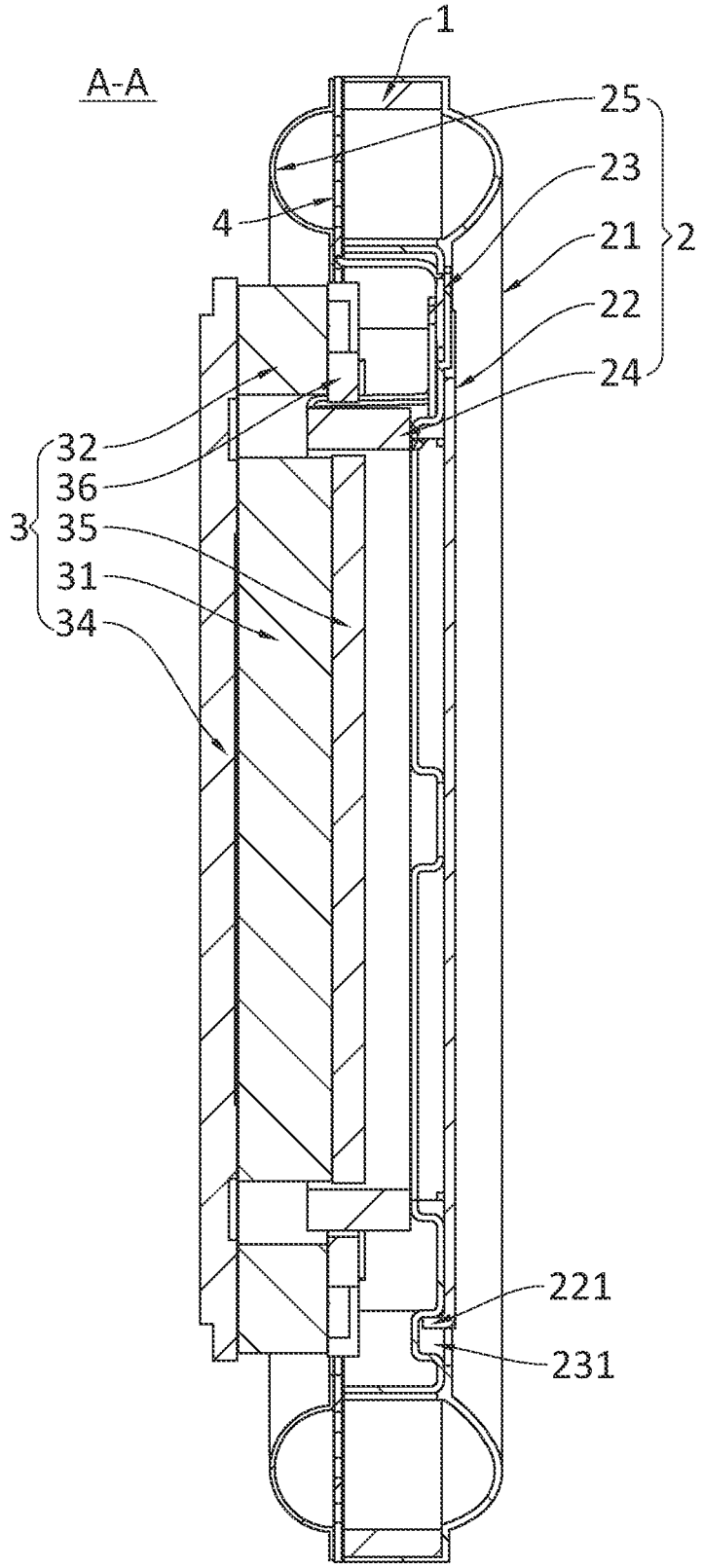
FIG. 2 is a sectional view taken along a cross section A-A of the sounding device shown in FIG. 1.
Figure 3:
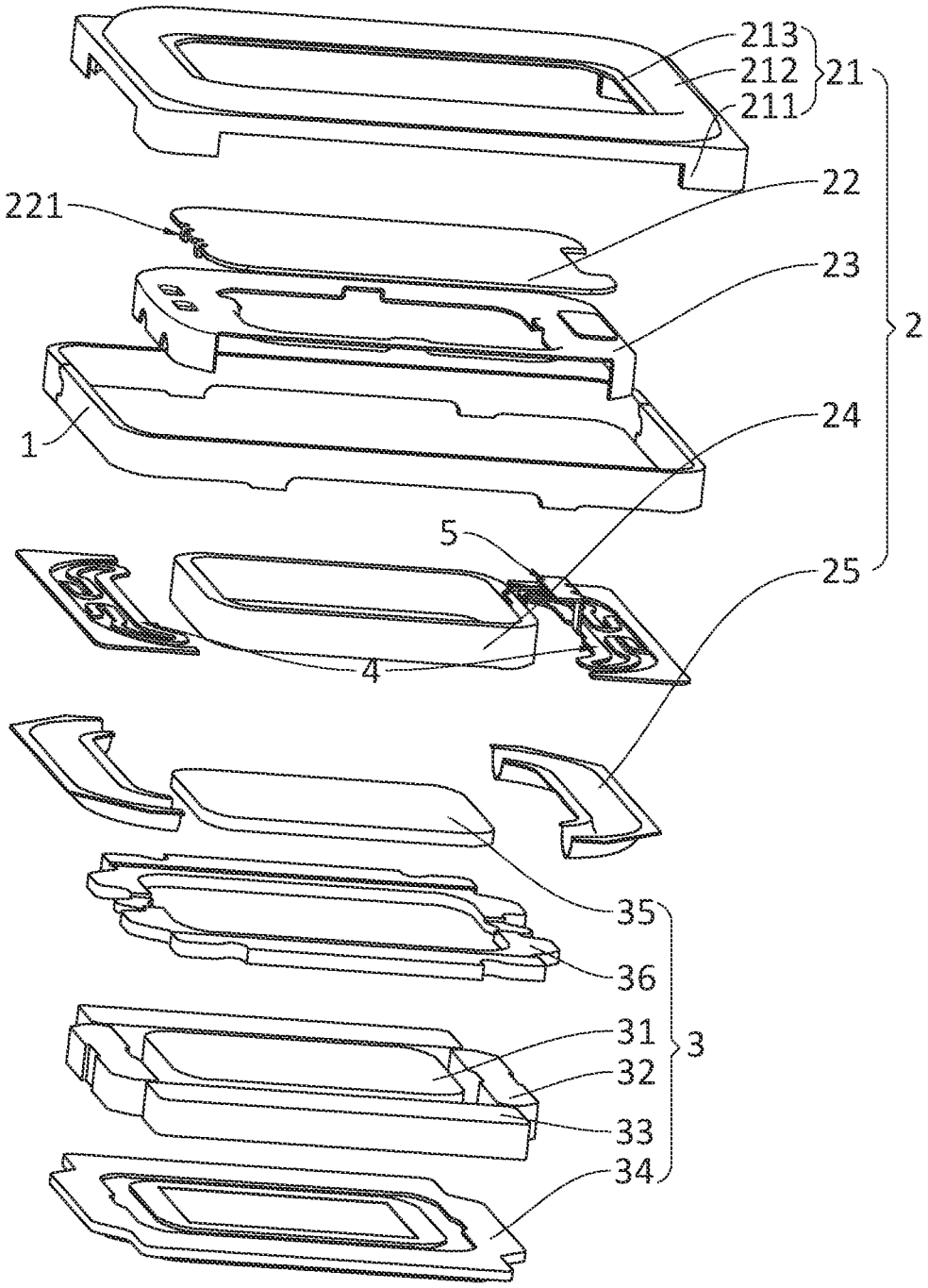
FIG. 3 is a schematic exploded view of the overall structure of the sounding device shown in FIG. 1.
Figure 4:
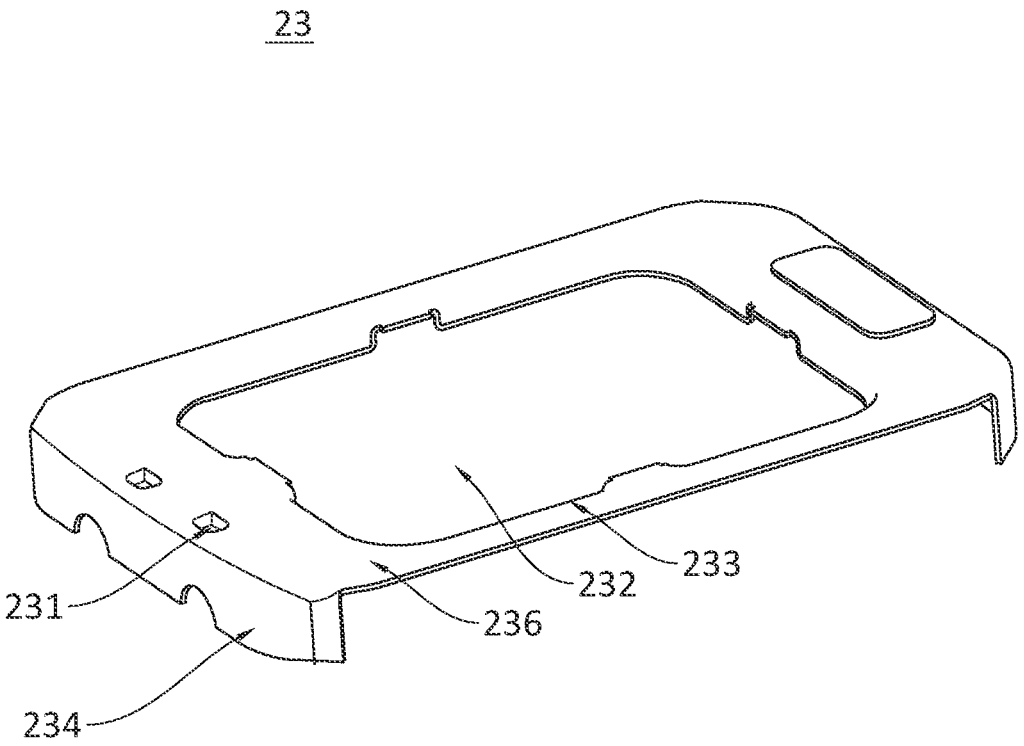
FIG. 4 is a schematic structural diagram of a holder shown in FIG. 3.
Figure 5:
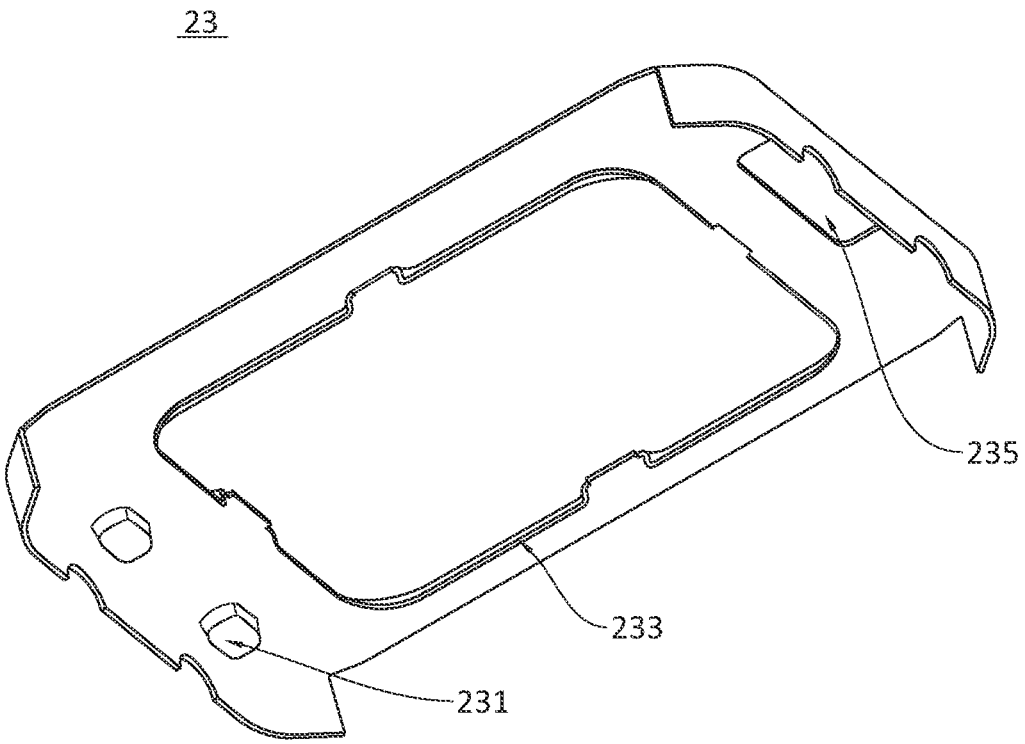
FIG. 5 is a bottom view of a holder shown in FIG. 3.

1: frame; 2: vibration system; 21: first diaphragm; 211: extension portion; 212: first suspension; 213: first connection portion; 22: dome; 221: positioning portion; 222: first notch; 223: second notch; 23: holder; 231: sink; 232: rectangular hole; 233: first extension arm; 234: second extension arm; 235: concave portion; 236: main body portion; 24: voice coil; 25: second diaphragm; 3: magnetic circuit unit; 31: main magnet; 32: first auxiliary magnet; 33: second auxiliary magnet; 34: yoke; 35: main pole plate; 36: auxiliary pole plate; 361: through hole; 362: first recess; 363: second recess; 4: flexible printed circuit board; 5: pad.

DESCRIPTION OF EMBODIMENTS

The present disclosure is further described below with reference to the accompanying drawings and embodiments. It is appreciated that, the described embodiments are merely some of rather than all of the embodiments of the present disclosure. All other embodiments acquired by those skilled in the art without creative efforts based on the embodiments of the present disclosure shall fall within the protection scope of the present disclosure.

The present disclosure discloses a vibration system 2, a sounding device and an electronic device, intended mainly to solve the technical problem of poor symmetry of assembly between a holder 23 and a dome 22 in the related art. Referring to FIG. 1 to FIG. 6, the present disclosure discloses a vibration system 2. The vibration system 2 includes a voice membrane fixed to a sounding device, a voice coil 24 received in the sounding device and configured to drive the voice membrane to vibrate, and a holder 23 supporting the voice coil 24. The voice membrane includes a dome 22 and a first diaphragm 21 arranged around the dome 22. The dome 22 and the first diaphragm 21 are fixed to the holder 23. The holder 23 is provided with a pad 5. The voice coil 24 is connected to the pad 5 through a lead wire. The dome 22 includes a first end close to the pad 5 and a second end away from the pad 5 and arranged opposite to the first end. The second end is provided with a positioning portion 221. The holder 23 is provided with a sink 231 configured to receive the positioning portion 221. The dome 22 is positioned with the holder 23 through the positioning portion 221 and the sink 231.

In an embodiment, two side surfaces of the holder 23 are fixedly connected to the dome 22 and the voice coil 24, respectively. The sink 231 is arranged on a surface of the holder 23 connected to the dome 22, that is, an upper surface of the holder 23. Two sinks 231 are located on a same side. Optionally, the two sinks 231 are arranged symmetrically with respect to a central axis of the holder 23. A cross section of the sink 231 may be in a shape of a rectangle, a square or a trapezoid. The dome 22 is provided with a first end and a second end. The first end and the second end are two end portions in a length direction of the dome 22, respectively, and the first end is close to the pad 5. The second end of the dome 22 is provided with a same number of positioning portions 221 as the sink 231. The positioning portion 221 is at a certain angle with a surface of the dome 22 to enable the dome 22 to be placed in the sink 231 through the positioning portion 221. Optionally, the angle between the positioning portion 221 and the dome 22 is 90 degrees. The shape and the size of the positioning portion 221 are set such that it can extend into the sink 231, which may be a rectangular block, a square block or a trapezoidal block. A top corner of the positioning portion 221 may be rounded. Through the engagement of the positioning portion 221 with the sink 231, symmetry of assembly between the dome 22 and the holder 23 can be ensured, and the two sinks 231 and the positioning portion 221 are further arranged in axial symmetry, which can further improve the symmetry of assembly between the dome 22 and the holder 23.

In addition, since the holder 23 is provided with the pad 5, two ends of the overall sounding device corresponding to positions of the first end and the second end of the dome 22 have different mass. That is, the mass is different on two sides of a central axis in a width direction of the dome 22, resulting in asymmetry of the mass. The mass of the pad 5 can be balanced through the positioning portion 221, so the sounding device to which the vibration system 2 of this embodiment is applied can have symmetric mass and produce better sound quality.

In other embodiments, the positioning portion 221 extends from an edge of the dome 22 to the sink 231. The dome 22 is provided with a first notch 222, and the positioning portion 221 is received in the first notch 222. The dome 22 is provided with the first notch 222 with a V-shaped opening at a position corresponding to the positioning portion 221. The positioning portion 221 is of an L-shaped structure. A short side of the positioning portion 221 is fixedly connected to the opening of the first notch 222.

In an embodiment, the dome 22 is of a rectangular plate structure, and the positioning portion 221 is of an L-shaped structure. An end surface of the dome 22 is provided with the first notch 222 with the V-shaped opening at the position corresponding to the positioning portion 221. The positioning portion 221 is fixedly connected to the V-shaped opening, and the V-shaped opening is filled to form two small V openings. The positioning portion 221 and the dome 22 are of an integrally-formed structure. The arrangement of the first notch 222 can facilitate the positioning portion 221 to be flush with the dome 22 and, at the same time, can reduce the mass of the dome 22.

In other embodiments, the vibration system further includes a flexible printed circuit board 4 opposite to and spaced from the first diaphragm 21, and a second diaphragm 25 arranged on one side of the flexible printed circuit board 4 away from the first diaphragm 21. The holder 23 includes a main body portion 236 connected to the dome 22 and the first diaphragm 21, a first extension arm 233 bending and extending from an inner periphery of the main body portion 236, and a second extension arm 234 bending and extending from an outer periphery of the main body portion 236. The first extension arm 233 is fixedly connected to the voice coil 24 to suspend the voice coil 24 below the dome 22, and the second extension arm 234 is fixedly connected to the flexible printed circuit board 4. A pad 5 of the flexible printed circuit board 4 bends and extends from an inner side of the second extension arm to one side of the main body portion 236 close to the second diaphragm 25.

In an embodiment, the holder 23 is of an annular plate structure. The holder 23 includes the main body portion 236, the first extension arm 233 and the second extension arm 234. The main body portion 236 is of an annular plate structure. The main body portion 236 is provided with a rectangular hole 232 in the middle. Four corners of the rectangular hole 232 may be rounded. The rectangular hole 232 is an inner circumference of the main body portion 236. The first extension arm 233 bends and extends from a hole wall of the rectangular hole 232 of the main body portion 236 to the voice coil 24 and is fixedly connected to the voice coil 24. The second extension arm 234 is arranged at two ends in a length direction of the main body portion 236, which is formed by bending from an outer periphery of the main body portion 236 in a same direction as the first extension arm 233. An extension length of the second extension arm 234 is greater than that of the first extension arm 233. The dome 22, the voice coil 24 and the first diaphragm 21 are connected through the holder 23, and the holder 23 and the dome 22 are symmetrically arranged and assembled, which can effectively improve uniformity of sound output by the voice coil 24.

The first diaphragm 21 includes an extension portion 211, a first suspension 212 and a first connection portion 213. The first diaphragm 21 is of a rectangular ring structure. The first connection portion 213 is at an innermost side and is configured to be fixedly connected to the holder 23, and the first connection portion 213 is arranged on an upper surface of the holder 23. A middle part of the first diaphragm 21 is the first suspension 212, the first suspension 212 is of a U-shaped structure, and an opening of the first suspension 212 is facing downward. A second connection portion is on an outermost side of the first diaphragm 21. The second connection portion is fixedly connected to the frame 1. Extension portions 211 wrapping the frame 1 vertically downwards are arranged at four corners of the second connection portion. The extension portions 211 are each of an L-shaped plate structure, are respectively arranged at the four corners, and are connected to the flexible printed circuit board 4 for support by the flexible printed circuit board 4.

In addition, two flexible printed circuit boards 4 are provided, which are respectively arranged outside two ends in a length direction of an outer side of the voice coil 24 by electrical connection, and on two ends corresponding to positions of the concave portion 235 and the sink 231. One side of the flexible printed circuit board 4 away from the first diaphragm 21 is provided with a second diaphragm 25. Two second diaphragms 25 are provided and are respectively connected to the two flexible printed circuit boards 4. The two second diaphragms 25 are symmetrically arranged and have a same structure. An opening of a second suspension of the second diaphragm 25 and the opening of the first suspension 212 are arranged in opposite directions. The entire vibration system 2 has a symmetric structure, and the frame 1 and the flexible printed circuit board 4 in coordination with the vibration system 2 are also arranged symmetrically. The pad 5 is also supplemented by the positioning portion 221 to achieve mass symmetry, which improves a sounding effect of the overall sounding device. In addition, the second diaphragm 25 does not sound.

In other embodiments, the main body portion 236 is provided with a receiving pad 5 and a concave portion 235.

In addition, in other embodiments, the concave portion 235 is convex on one side of the main body portion 236 away from the second diaphragm 25, and the dome 22 is provided with a second notch 223 at a position corresponding to the concave portion 235.

In an embodiment, the concave portion 235 is formed by depression of the main body portion 236 and the voice coil 24 to the dome 22. A cross section of the concave portion 235 may be in a shape of a rectangle or a trapezoid. An area of the cross section of the concave portion 235 is greater than that of the pad 5, so that the pad 5 can be received, preventing collision between the pad 5 and the main body portion 236. The dome 22 is provided with a second notch 223 at a part protruding corresponding to the concave portion 235. A size of the second notch 223 is greater than that of the concave portion 235.

The present disclosure further discloses a sounding device, including the vibration system 2 as described in any one of the above embodiments, a magnetic circuit unit 3 configured to drive the vibration system 2 to vibrate and sound, and a frame 1 configured to mount the vibration system 2 and the magnetic circuit unit 3.

The technical problem of poor symmetry of assembly between the holder 23 and the dome 22 in the related art can be solved by applying the vibration system 2 mentioned above to the sounding device and by improving the symmetry of assembly between the holder 23 and the dome 22. Moreover, the mass of the pad 5 can also be balanced through the positioning portion 221, so that the mass of two ends in the length direction of the sounding device is symmetric, which can improve the sound quality.

In other embodiments, the magnetic circuit unit 3 includes a yoke 34, a main magnet 31 fixed to the yoke 34, an auxiliary magnet arranged on a peripheral side of the main magnet 31, a main pole plate 35 attached to one side of the main magnet 31 away from the yoke 34, and an auxiliary pole plate 36 attached to one side of the auxiliary magnet away from the yoke 34. A magnetic gap is formed between the auxiliary magnet and the main magnet 31. The voice coil 24 is inserted into the magnetic gap, the auxiliary pole plate 36 is arranged around the voice coil 24, and the auxiliary pole plate 36 is provided with a first recess 362 configured to avoid the pad 5 at a position corresponding to an orthographic position of the pad 5.

In addition, in other embodiments, the magnetic circuit unit 3 includes a yoke 34, a main magnet 31 fixed to the yoke 34, two first auxiliary magnets 32 respectively spaced on two opposite sides of the main magnet 31, two second auxiliary magnets 33 respectively spaced on the other two opposite sides of the main magnet 31, a main pole plate 35 attached to one side of the main magnet 31 away from the yoke 34, and an auxiliary pole plate 36 attached to one side of the first auxiliary magnet 32 and the second auxiliary magnet 33 away from the yoke 34. The first auxiliary magnet 32, the second auxiliary magnet 33 and the main magnet 31 form the magnetic gap together. The auxiliary magnet is set as the first auxiliary magnets 32 and the second auxiliary magnets 33 opposite to each other, which can facilitate the symmetric setting of the overall magnetic circuit unit 3 and improve the sound quality of the output sound.

The magnetic circuit unit 3 includes a yoke 34, a main magnet 31 fixed to the yoke 34, an auxiliary magnet arranged around the main magnet 31, a main pole plate 35 attached to one side of the main magnet 31 away from the yoke 34, and an auxiliary pole plate 36 attached to one side of the auxiliary magnet away from the yoke 34. A magnetic gap is formed between the auxiliary magnet and the main magnet 31. The voice coil 24 is away from one side of the holder 23 and is inserted into the magnetic gap, the auxiliary pole plate 36 is arranged around the voice coil 24, and the auxiliary pole plate 36 is provided with a first recess 362 configured to avoid the pad 5 at a position corresponding to an orthographic position of the pad 5.

In an embodiment, the auxiliary pole plate 36 is provided with the first recess 362 at a position corresponding to the pad 5. The shape of the first recess 362 may be set to a variety of styles, such as an arc, a wave or a rectangle, while ensuring the symmetric structure of the auxiliary pole plate 36. The arrangement of a hole on the auxiliary pole plate 36 can avoid the pad 5 during vibration, which increases vibration amplitude of the pad 5, improves the sound quality of the output sound, and can prevent sound collision.

In other embodiments, the auxiliary pole plate 36 is of an axisymmetric structure, and the other side of the auxiliary pole plate 36 opposite to the first recess 362 is provided with a second recess 363 symmetric with the first recess 362. The auxiliary pole plate 36 is provided with a through hole 361 configured to wrap the auxiliary pole plate 36 around the voice coil 24.

Figure 6:
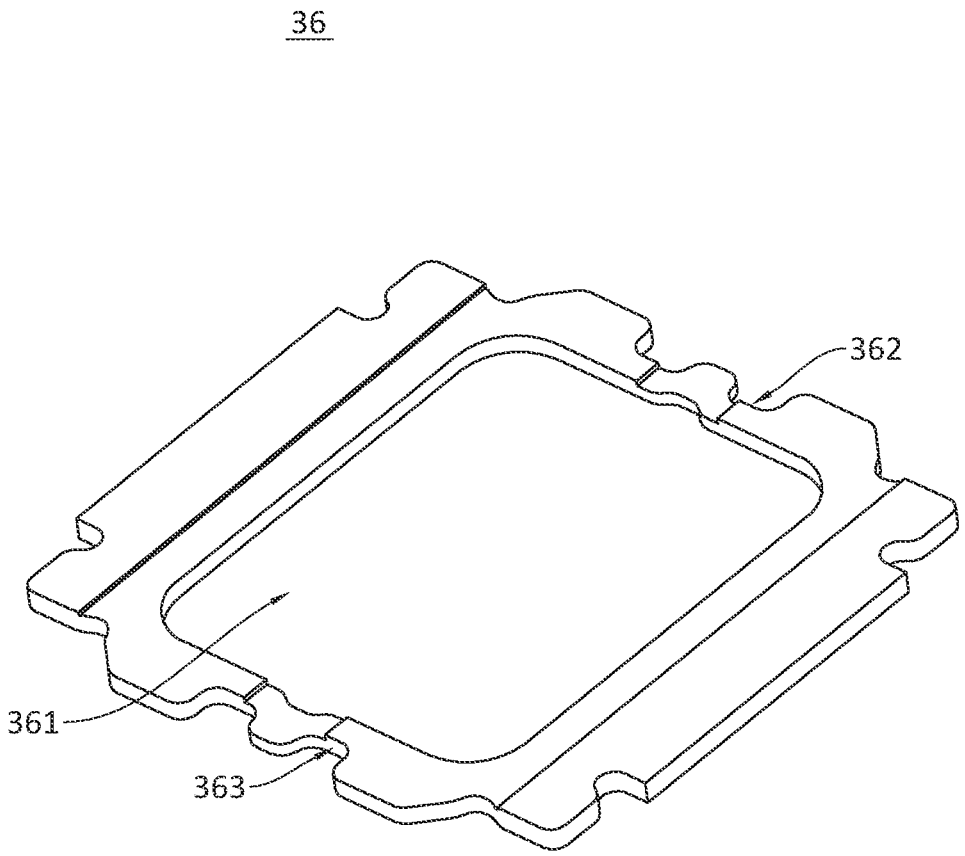
FIG. 6 is a schematic structural diagram of an auxiliary pole plate shown in FIG. 3.

In an embodiment, as shown in FIG. 6, the auxiliary pole plate 36 is of an annular block structure. Different from the related art in which a plurality of auxiliary pole plates 36 are provided, the auxiliary pole plate 36 according to the present disclosure is a single annular block. The auxiliary pole plate 36 is of an axisymmetric structure. The auxiliary pole plate 36 is provided with the through hole 361 in the middle, which is configured to sleeve an outer circumference of the voice coil 24 with the auxiliary pole plate 36. Two ends of the auxiliary pole plate 36 are respectively provided with the first recess 362 and the second recess 363. The first recess 362 may have a wave shape. A first engaging boss is arranged at a middle position of two ends of the auxiliary pole plate 36, which facilitates fitting and mounting. Moreover, the auxiliary pole plate 36 has a symmetric structure, which is conductive to the symmetry of magnetic circuits, and improving the distortion and the overall performance of the sounding device.

The frame 1 is of an annular structure. A third recess is arranged on the frame 1 relative to the two first extension arms 233. A side of the third recess is adjacent to the side of the pad 5. The auxiliary pole plate 36 extends from the third recess into the third recess and is flush with an outer side surface of the frame 1.

In an embodiment, two sides of the auxiliary pole plate 36 are provided with second engaging bosses. The second engaging boss has a rectangular block structure. A stepped stage is formed between the second engaging boss and the auxiliary pole plate 36. A side edge of the second engaging boss away from the through hole 361 is provided with a strip block that extends into the third recess. A side surface of the strip block is flush with an outer side surface of the frame 1. This can improve assembly and positioning effects of the auxiliary pole plate 36 and the frame 1.

The present disclosure further discloses an electronic device, including the sounding device as described in any one of the above embodiments. The sounding device according to the present disclosure is applied to the electronic device, so that the electronic device has better sound quality and can improve the distortion.

The above are only embodiments of the present disclosure. It should be pointed out that those of ordinary skill in the art may also make improvements without departing from the ideas of the present disclosure, all of which fall within the protection scope of the present disclosure.

What is claimed is:

1. A vibration system, comprising a voice membrane, a voice coil configured to drive the voice membrane to vibrate, and a holder provided with a pad, the voice membrane comprising a dome and a first diaphragm arranged around the dome, the dome and the first diaphragm being fixed to the holder, the voice coil being connected to the pad through a lead wire, wherein the dome comprises a first end close to the pad and a second end away from the pad and arranged opposite to the first end, the second end is provided with a positioning portion, the holder is provided with a sink configured to receive the positioning portion, and the dome is positioned with the holder through engagement of the sink with the positioning portion.

2. The vibration system as described in claim 1, wherein the positioning portion extends from an edge of the dome to the sink.

3. The vibration system as described in claim 2, wherein the dome is provided with a first notch, and the positioning portion is received in the first notch.

4. The vibration system as described in claim 1, further comprising a flexible printed circuit board opposite to and spaced from the first diaphragm, and a second diaphragm arranged on one side of the flexible printed circuit board away from the first diaphragm, wherein the holder comprises a main body portion connected to the dome and the first diaphragm, a first extension arm bending and extending from an inner periphery of the main body portion, and a second extension arm bending and extending from an outer periphery of the main body portion, the first extension arm is fixedly connected to the voice coil to suspend the voice coil below the dome, the second extension arm is fixedly connected to the flexible printed circuit board, and a pad of the flexible printed circuit board bends and extends from an inner side of the second extension arm to one side of the main body portion close to the second diaphragm.

5. The vibration system as described in claim 4, wherein the main body portion is provided with a concave portion for receiving the pad.

6. The vibration system as described in claim 5, wherein the concave portion protrudes on one side of the main body portion away from the second diaphragm, and the dome is provided with a second notch at a position corresponding to the concave portion.

7. A sounding device, comprising the vibration system as described in claim 1, a magnetic circuit unit configured to drive the vibration system to vibrate and sound, and a frame configured to mount the vibration system and the magnetic circuit unit.

8. The sounding device as described in claim 7, wherein the magnetic circuit unit comprises a yoke, a main magnet fixed to the yoke, an auxiliary magnet arranged on a peripheral side of the main magnet, a main pole plate attached to one side of the main magnet away from the yoke, and an auxiliary pole plate attached to one side of the auxiliary magnet away from the yoke, a magnetic gap is formed between the auxiliary magnet and the main magnet, and the voice coil is inserted into the magnetic gap, the auxiliary pole plate is arranged around the voice coil, and the auxiliary pole plate is provided with a first recess at a position corresponding to an orthographic position of the pad to avoid the pad.

9. The sounding device as described in claim 8, wherein the auxiliary pole plate has an axisymmetric structure, and the other side of the auxiliary pole plate opposite to the first recess is provided with a second recess symmetric with the first recess.

10. An electronic device, comprising the sounding device as described in claim 7.

* * * * *